US005945650A

United States Patent [19]

Holland et al.

[11] Patent Number: 5,945,650

[45] Date of Patent: Aug. 31, 1999

[54] POLYPHASE ROTARY SWITCH INCLUDING ARC CHAMBER SYSTEM WITH ARC GRIDS, LINE SHIELDS AND BAFFLES

[75] Inventors: Michael J. Holland, Hilliard; Steven E. Pever, Bellefontaine, both of Ohio

[73] Assignee: Siemens Energy & Automation,Inc., Alpharetta, Ga.

[21] Appl. No.: 09/053,886

[22] Filed: Apr. 2, 1998

[51] Int. Cl.[6] ..... H01H 9/30; H01H 21/54; H01H 33/04

[52] U.S. Cl. ..... 218/1; 200/15; 218/15; 218/34; 218/149; 218/152; 218/156

[58] Field of Search ..... 200/15, 254, 259–261, 200/293; 218/1, 15, 41, 46, 47, 113, 147, 149–152, 155–158, 76, 81; 361/643, 679, 835, 837

[56] References Cited

U.S. PATENT DOCUMENTS

| | | | |
|---|---|---|---|
| 558,343 | 4/1896 | Bergquist | 200/570 |
| 1,153,656 | 9/1915 | Wake | 200/562 |
| 1,534,516 | 4/1925 | Getchell | 337/143 |
| 1,780,684 | 11/1930 | Owens | 218/89 |
| 1,785,194 | 12/1930 | Hammerly | 200/571 |
| 2,100,753 | 11/1937 | Schofield et al. | 218/113 |
| 2,457,002 | 12/1948 | Spiro | 218/155 X |
| 2,863,969 | 12/1958 | Edmunds | 218/152 |
| 3,041,432 | 6/1962 | Tillson | 200/337 |
| 3,077,525 | 2/1963 | Dyer | 337/7 |
| 3,114,024 | 12/1963 | Tillson | 200/293 |
| 3,202,775 | 8/1965 | Tillson | 200/6 R |
| 3,439,108 | 4/1969 | Zerwes | 174/53 |
| 3,472,945 | 10/1969 | Trachtenberg | 174/53 |
| 3,632,935 | 1/1972 | Stegmaier | 200/571 |
| 3,748,620 | 7/1973 | Ellsworth et al. | 337/20 |
| 3,800,106 | 3/1974 | Simmons | 200/15 |
| 3,840,717 | 10/1974 | Pekrul et al. | 200/284 |
| 3,917,920 | 11/1975 | Pekrul et al. | 200/571 |
| 3,958,095 | 5/1976 | Zaffrann et al. | 200/293 |
| 4,233,643 | 11/1980 | Iverson et al. | 361/616 |
| 4,251,700 | 2/1981 | Zaffrann et al. | 218/12 |
| 4,302,643 | 11/1981 | Cox et al. | 218/152 |
| 4,480,161 | 10/1984 | Kellog et al. | 218/149 |
| 4,527,027 | 7/1985 | Link et al. | 218/1 |
| 4,675,481 | 6/1987 | Markowski et al. | 218/1 |
| 4,689,716 | 8/1987 | Cooper et al. | 361/837 |
| 4,755,909 | 7/1988 | Hibbert et al. | 361/837 |
| 4,778,959 | 10/1988 | Sabatella et al. | 218/1 |
| 4,778,961 | 10/1988 | M'Sadoques et al. | 200/17 R |
| 4,791,255 | 12/1988 | Eliezer | 218/1 |
| 4,926,290 | 5/1990 | Mizerak | 361/679 |
| 4,959,514 | 9/1990 | Robarge et al. | 218/149 |
| 5,013,870 | 5/1991 | Navazo | 174/50 |
| 5,159,538 | 10/1992 | Wells et al. | 361/835 |
| 5,181,164 | 1/1993 | Beard et al. | 361/617 |
| 5,357,066 | 10/1994 | Morel et al. | 200/17 R |
| 5,434,376 | 7/1995 | Hyatt et al. | 200/293 |
| 5,483,416 | 1/1996 | Goe, Jr. | 361/600 |
| 5,486,650 | 1/1996 | Yetter | 174/53 |
| 5,590,019 | 12/1996 | Fox et al. | 361/643 |
| 5,609,245 | 3/1997 | Cassity et al. | 200/283 |

*Primary Examiner*—J. R. Scott
*Attorney, Agent, or Firm*—Ira Lee Zebrak

[57] ABSTRACT

A multi-phased switch support base including a molded top cover and a molded bottom base each having interior and exterior walls which divide the interiors. When assembled together the base is divided into compartmentalized arc chambers which function to isolate each line contact and each load contact of each phase of the switch from each other as well as from each other line and each other load contact of each of the other phases of the switch. A multiplicity of unique snap-in arc chutes and baffles to help control and extinguish the arc generated during disconnect operations of the rotor from the stationary contacts are provided in each arc chamber.

23 Claims, 13 Drawing Sheets

POLYPHASE ROTARY SWITCH INCLUDING ARC CHAMBER SYSTEM WITH ARC GRIDS, LINE SHIELDS AND BAFFLES

FIELD OF THE INVENTION

The present invention relates to electric switches, and more particularly to enclosed manually operated fused and non fused switches.

BACKGROUND OF THE INVENTION

Enclosed manually operated fused and non-fused switches suffer from a number of limitations. Frequently, problems are caused in the assembly of switches because of the substantial quantity of parts which must be manufactured, tracked, inventoried, and assembled, as well as supplied in the field to properly complete or modify the switch from non-fused to fused operation or vice-versa. With continuing competitive pressure of the marketplace, the parts of the switch, as well as the switch as a whole, must be economical to manufacture. Switch design needs to be simplified for the purpose of facilitating assembly at the point of manufacture, as well as for modification in the field. Design demands for switches to be more compact and sturdy and more readily wired and inspected continue to be ongoing.

Another objective of switch design is to provide a construction for a terminal base which fits together with a minimum number of tools as well as parts, and which may be sold or used as a fused or non-fused switch. There is also a need to provide an improved rotor assembly, improved arc suppression, and compartmentalization of arc gases which may be generated during disconnect operations of the switch. There is also a further need to provide improved means in the housing of the switch for the insertion and maintenance of arc suppressers without the need for any mechanical fasteners.

It would also be an advantage to provide new arc suppression chambers, and uniquely shaped arc grids for a multi-phase switch base which can be snapped into position within compartmentalized arc chambers within the switch base. It would be a further advantage to provide a new and improved line contact—line lug combination and interchangeable load contact—fuse clip combination to the switch base as well as an improved alignment and support arrangement.

Thus, a switch which can be assembled easier, faster, cheaper, and with fewer parts, as well as providing improved performance and adaptability, will enjoy a substantial competitive advantage.

SUMMARY OF THE INVENTION

In accordance with one aspect of the invention, a multiple phase fusible switch assembly having a main disconnect switch mechanism support base is provided comprising: (a) a molded bottom base having a bottom surface, upstanding side outer walls, upstanding front and rear outer walls, first upstanding interior walls, and second upstanding interior walls transverse to the first upstanding interior walls, dividing the interior of the bottom base for isolating each phase of the switch; (b) a molded top cover having a top surface, depending side outer walls, depending front and rear outer walls, and first depending interior walls, dividing the interior of the top cover for isolating each phase of the switch; (c) the molded top cover being mountable to the molded bottom base wherein the depending side outer walls and the depending front and rear outer walls of the top cover are in mutual engagement with the upstanding side outer walls and the upstanding front and rear outer walls of the bottom base, and the first upstanding interior walls of the bottom base are in mutual engagement with the first depending interior walls of the top cover to form phase to phase separation chambers for isolating each phase in the main disconnect switch mechanism support base; (d) a plurality of pairs of stationary contacts comprising a line contact secured to the bottom surface of the base in each of the phase to phase separation chambers and a load contact secured to the top surface and extending into each of the phase to phase separation chambers; (e) means disposed in the molded bottom base in proximity to the line contact and disposed in the molded top cover in proximity to the load contact in each of the phase to phase separation chambers for receiving arc extinguishing devices; (f) a rotor assembly supported and guided by the upstanding side outer walls of the bottom base and the depending side outer walls of the top cover, the rotor assembly having a rotor shaft arranged between the molded top cover and molded bottom base and between the line contact and the load contact for rotating a contact assembly between the line contact and the load contact to make circuit connection between the line contact and the load contact in each of the phase to phase separation chambers; and (g) wherein the second upstanding interior wall has a free edge in mutual engagement with the rotor shaft to form a barrier between the line contact and the load contact in each of the phase to phase separation chambers to form compartmentalized arc chambers isolating each line contact and each load contact of each phase of the switch from each other, and from each other line contact and each other load contact of each other phase of the main disconnect switch support base. The means for receiving arc extinguishing devices is in the front outer wall and rear outer wall of the molded bottom base and in the front outer wall and the rear outer wall in the molded top cover. The means for receiving arc extinguishing devices further includes an integrally molded protruding member and a tab in each of upstanding front and rear outer walls of molded bottom base for receiving snap-in arc grids and an integrally molded protruding member and a tab in each of depending front and rear outer walls of molded top cover for receiving snap-in arc grids. The switch further includes arc extinguishing devices which comprises unique snap-in arc grids each formed from a single piece of metal and inserted into the means for receiving arc extinguishing devices disposed in the front and rear outer walls of the molded bottom base and in the front and rear outer walls of the molded top cover.

DETAILED DESCRIPTION

Figure 1:
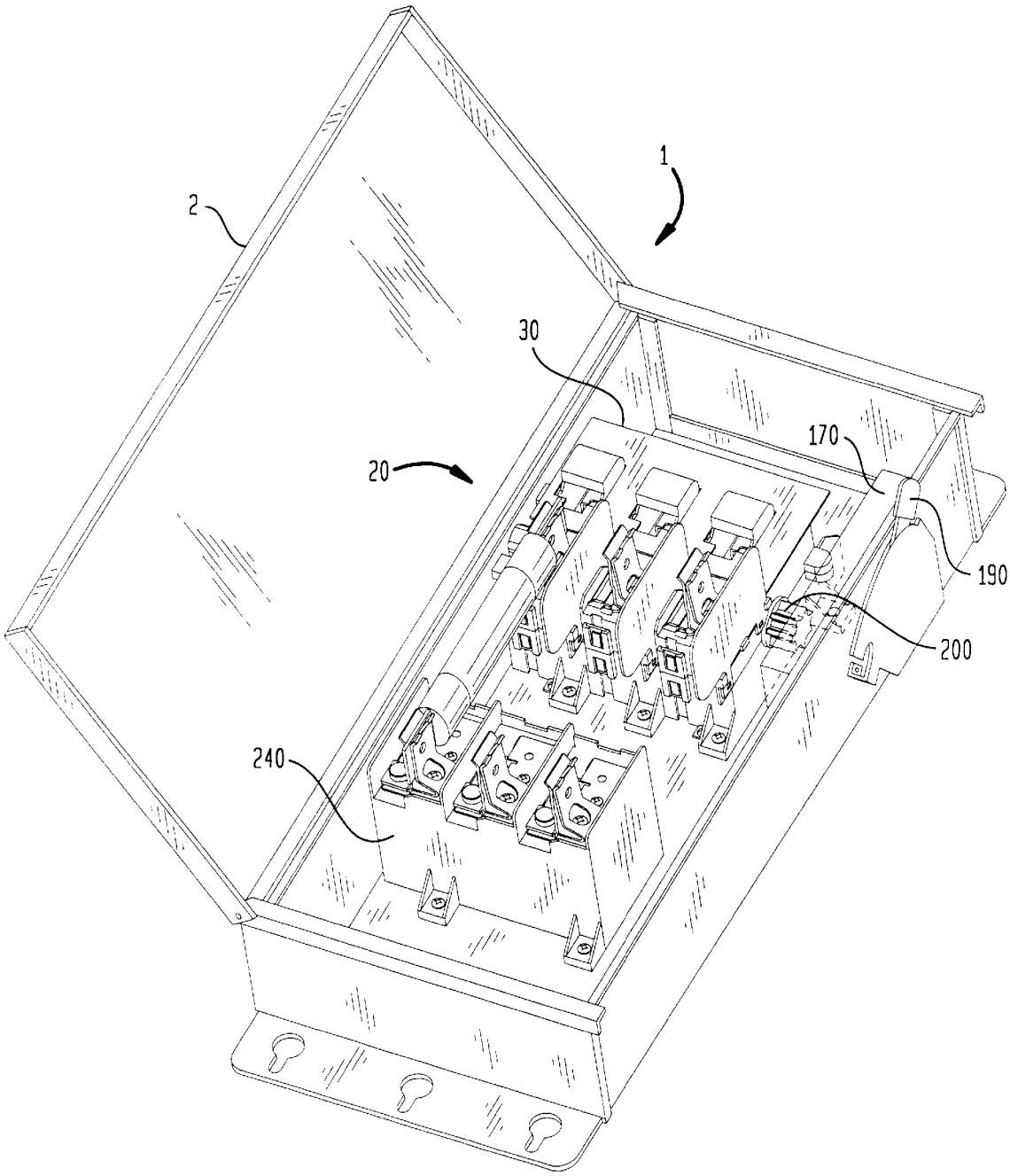
FIG. 1 is a perspective view of the Main Disconnect Switch Mechanism with a Fuse Support Mechanism within an enclosure.

Referring to FIG. 1, in accordance with the present invention, Main Disconnect Switch Mechanism 20 is shown with Main Disconnect Switch Support Base 30 and an optional and smaller Fuse Support Mechanism 240 mounted and positioned by screws within enclosure 1 defined by sidewalls, top and bottom walls, back wall, and with door 2 opened. Also shown is a handle 190 to activate an operating mechanism 170 for opening and closing a switch contact as is well known in that art, and is positioned within and secured to enclosure 1. In a preferred embodiment, operating mechanism 170 operates a rotor assembly 200 of Main Disconnect Switch Mechanism from an ON to an OFF and vice versa positions. More specifically, the contacts of the three phases of the Main Disconnect Switch Mechanism are selectively engaged and disengaged by rotating pairs of moveable blades extending 180° from one another from within the rotor shaft for closing and opening the switch. Such type of opening/closing using a rotating pair(s) of moveable blades to make and break contact with a stationary mating load contact and a stationary line contact is commonly referred to as a double make/double break switch. Double make/break switch(es) typically will have far less tendency for arc duration than a single break switch.

Figure 2:
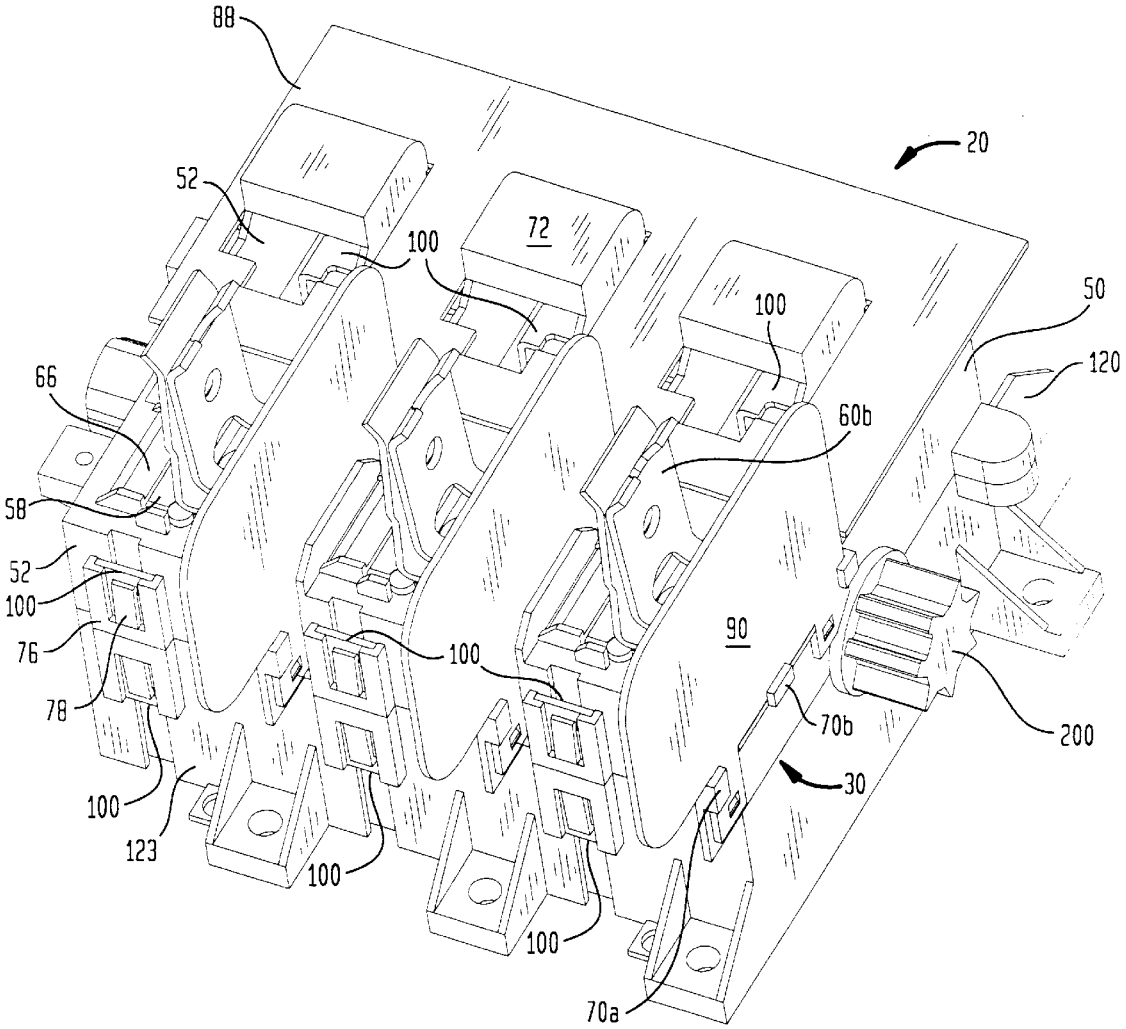
FIG. 2 is an isolated perspective view of the Main Disconnect Switch Mechanism Support Base shown in FIG. 1.

Referring to FIG. 2, the Main Disconnect Switch Mechanism Support Base 30 serves as a switch base and includes a molded top cover 50, a mating molded bottom base 120, a molded lineshield 88, and an insulated rotor assembly 200.

Figure 12:
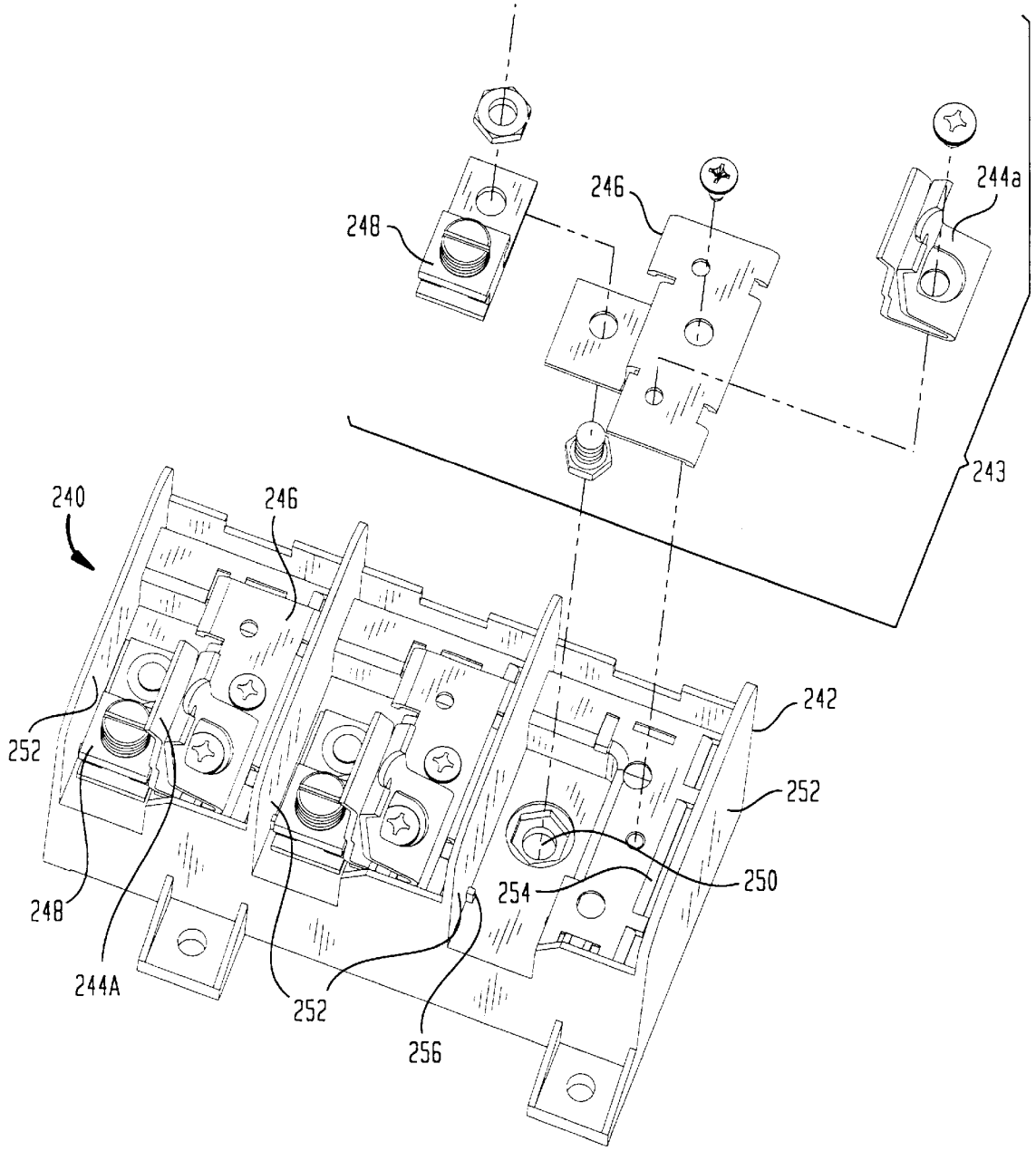
FIG. 12 is an exploded perspective view of the Fuse Support Mechanism for use in a fused Main Disconnect Switch Mechanism shown in FIG. 1 and shown with a blade type fuse clip.
Figure 13:
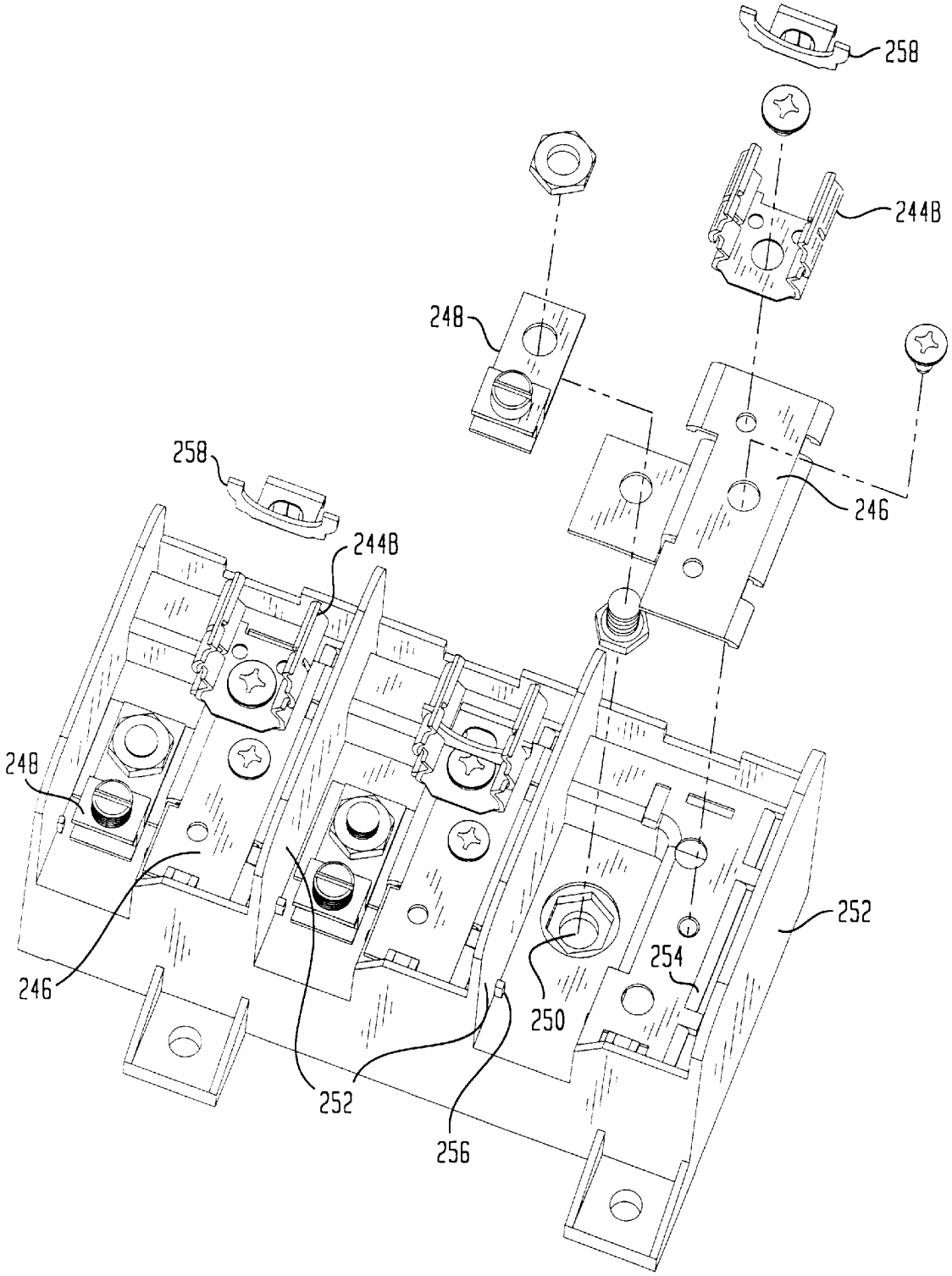
FIG. 13 is an exploded perspective view of the Fuse Support Mechanism for use in providing a fused Main Disconnect Switch Mechanism as in FIG. 1 but with a ferrule fuse clip.
Figure 14:
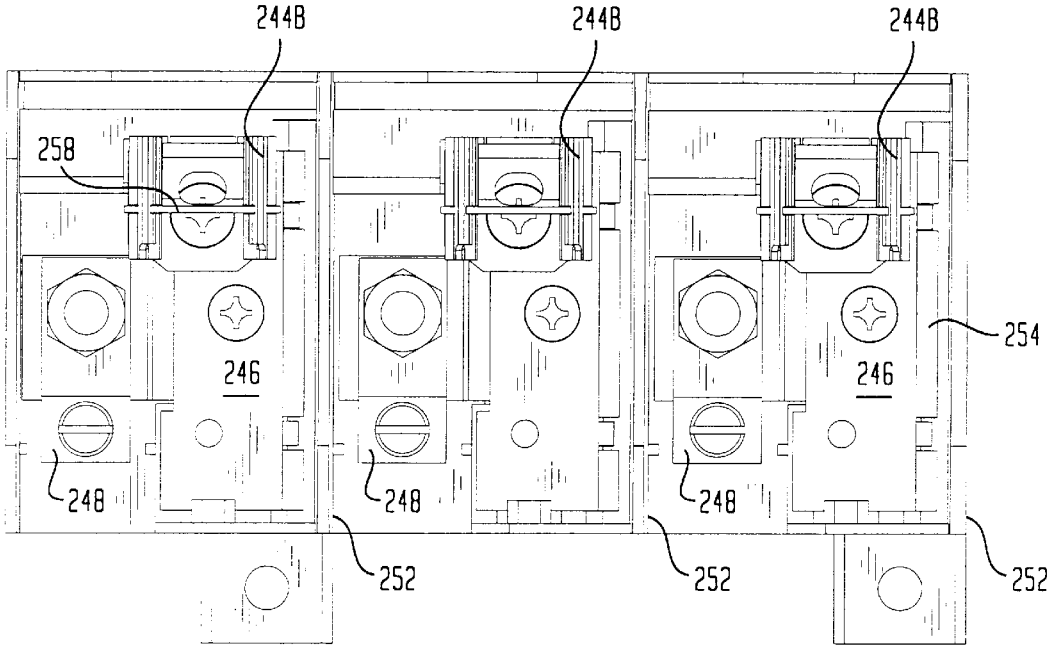
FIG. 14 is a top view of the Fuse Support Mechanism shown in FIG. 13.

The molded top cover 50 has molded in features for either load terminals, or blade fuse clips or ferrule fuse clips that can be attached to load stationary contacts for fused operation allowing current to be transferred to fuse elements supported by Fuse Support Mechanism 240 (FIGS. 12–14). In addition, top cover 50 has molded features that allow a variety of fuse barriers to snap into predetermined positions without additional fasteners. The top cover also holds separate snap-in arc grids and integrally incorporates baffles to help control the arcs generated during the disconnect operation of the switch. Also formed into top cover 50 are interior walls which when mated to the bottom base (which also have interior walls) form compartmentalized arc chambers. Load stationary contacts are held in their positions relative to the rotor assembly by mounting them securely to the top cover. Top cover 50 (as well as molded bottom base 120) also positions the insulated rotor assembly relative to the line contacts. Line stationary contacts are similarly held in their positions relative to the rotor assembly by mounting them securely to bottom base 120 which also positions the insulated rotor relative to the line contacts.

The bottom base 120 also holds separate snap-in arc grids and integrally incorporates baffles to help control the arcs generated during disconnect operation. Formed into bottom base are interior walls that function when assembled with the interior walls in the top cover as compartmentalized arc chambers. The base also positions the insulated rotor and provides the surface on which the rotor rides.

Figure 3A:
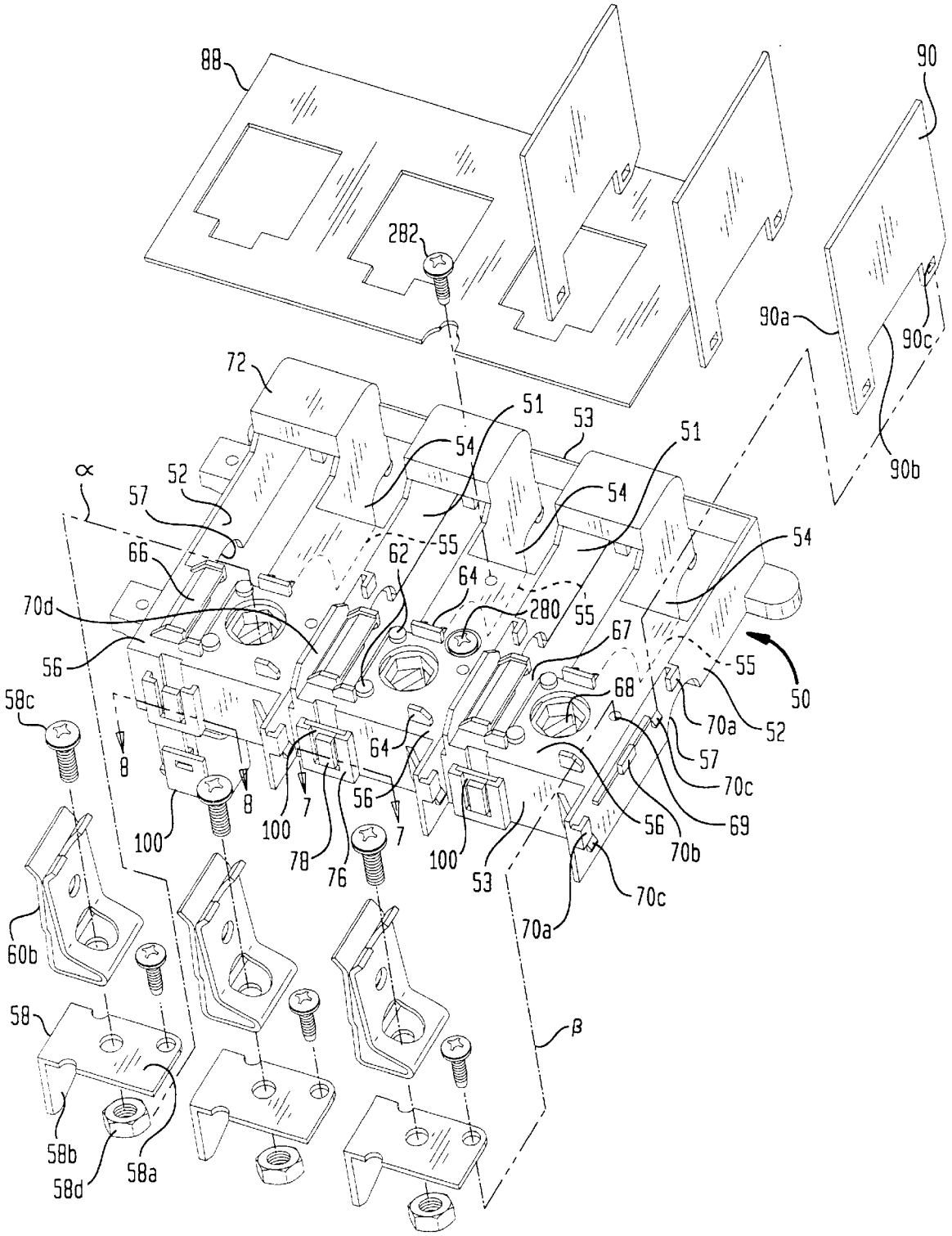
FIG. 3A is an exploded perspective view of the molded top cover of the Main Disconnect Switch Mechanism Support Base shown in FIG. 2.

Referring to FIG. 3A, an exploded perspective view is shown of the molded top cover 50 of the Main Disconnect Switch Mechanism Support Base 30 and is shown with a blade fuse clip for operation as a fused switch. Molded top cover comprises depending side outer walls 52 which intersect depending front and rear outer walls 53. First depending interior walls 51 and second depending interior walls 54 extend transverse to front and rear outerwalls 53 and parallel to side outer walls 52. Walls 52, 53, and 54 are joined at their upper edges by top surface 56. Each of walls 51, 52, 54 has a radial slot 57 for receiving the correspondingly positioned rotor assembly 200 as detailed further. Each of interior walls 54 has an integrally molded tab 55 which functions in conjunction with the interior walls of base 120 to compartmentalize within a chamber the electric arc which may be created during operations of the switch.

The interior walls 51 and 54, and tabs 55 divide the interior of the molded top cover, so that when rotor assembly 200, line shield 88, and molded bottom base are assembled together, Main Disconnect Switch Mechanism Support Base 30 is divided into compartmentalized arc chambers for each of the different phases of the switch. These compartmentalized arc chambers function, in part, to isolate each line contact and each load contact of each phase of the switch from each other line and each other load contacts of each of the other phases of the switch as more fully described below.

Top surface 56 has integrally molded a slit 67 and a hood 66 for each phase of the switch for the receipt of L-shaped load stationary contact 58, and more specifically the vertical portion 58*b* which extends into the interior of top cover 50. Once L-shaped load contact 58 is secured to top cover 50, hood 66 which is positioned over the bend at the intersection of the horizontal portion 58*a* and vertical portion 58*b* of load contact 58, it is prevented from being loosened during the repeated opening and closing of the contact with the conductive blades 204 of the rotor assembly 200.

Figure 3B:
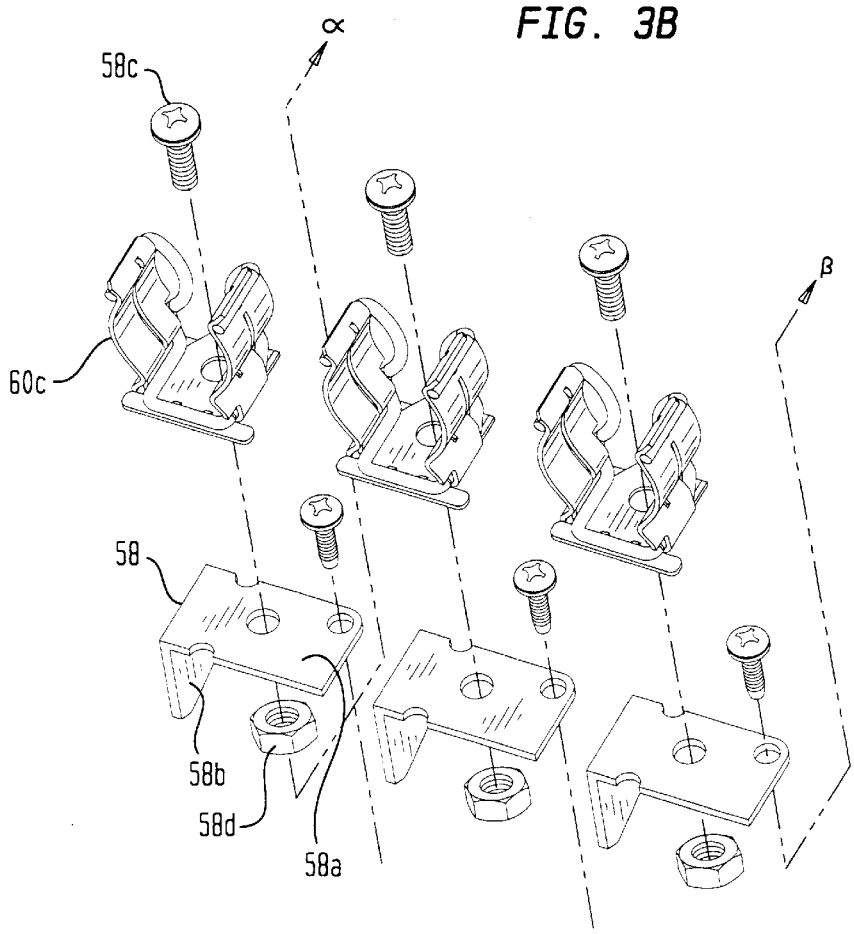
FIG. 3B is an exploded perspective view showing that portion of the molded top cover of the Main Disconnect Switch Mechanism Support Base shown in FIG. 2 with the blade type fuse clip replaced by a ferrule fuse clip.
Figure 3C:
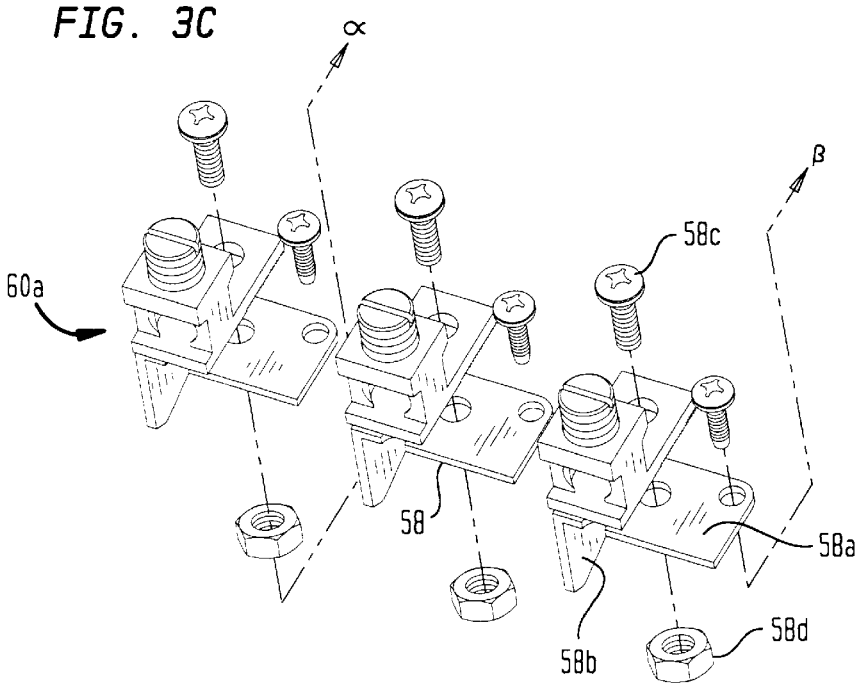
FIG. 3C is an exploded perspective view showing that portion of the molded top cover of the Main Disconnect Switch Mechanism Support Base shown in FIG. 2 with the blade type fuse clip replaced by a load terminal for non-fused operation of the Main Disconnect Switch Mechanism.

Although a load blade fuse clip 60*b* (and more particularly one that can be used as a fuse rejector) as shown in FIGS. 2 and 3A is secured to L-shaped stationary load contact 58, alternatively an interchangeable load ferrule fuse clip 60*c* (FIG. 3B) can be utilized during manufacture or by the end user with contact 58 when different fusing requirements are desired, or an interchangeable load terminal 60*a* (FIG. 3C) when fusing the switch is either not desired or needed. Molded recess 68 in top surface 56 receives nut 58*d* which is used to secure blade fuse clip 60*b* (or ferrule fuse clip 60*c* or load terminal 60*a*) to load contact 58 by screw 58*c* to facilitate their assembly. Molded recess 68 is in the shape and size of nut 58*d* securing, interchangeably, either blade fuse clip 60*b*, ferrule fuse clip 60*c*, or load terminal 60*a*, to load contact 58. Mating the shape of recess 68 to nut 58*d* prevents the rotation of the nut when securing these components together while positioned in the top surface 56. The assembled components are secured to top surface 56 by tightening screw 58*e* into aperture 69. Molded anti-turn features which prevent the rotation of these assembled components extend upward from the top surface 56 and are shown in the form of nodules 62 and elevated bars 64 and preclude the rotation of the load contact 58 and assembled fuse clip 60*b* (or fuse clip 60*c* or load terminal 60*a*) during repeated operation of the switch.

In response to the continuing pressure of industry to reduce the size of electrical switches, housings have become smaller and thereby reducing or eliminating access space to interior components and sub-components. In the prior art, access to field installed components such as fuses or fuse ejectors was provided by spacing the poles of the switch further apart. In order to fit the switch in an even smaller envelope, such as in applications in "I" beam posts or panel board units, the width of the switches had to be reduced. As electrical devices were made narrower, fuse ejectors again became necessary due to the lack of fuse accessibility. Also, since the barriers between phases of the switches in the prior art are molded into the switch, it was not possible to provide the switch without the barriers even when the switch was not provided with or operated with a fuse. The prior art barriers required greater barrier wall thickness due to the need for tall barriers which in turn increased the amount of molding material used for the switch. The greater wall thickness also increased the amount of time to manufacture the part, and the taller barriers are more fragile and prone to shipping damage.

In accordance with an aspect of the present invention, the problem of including adequate barriers on electrical switches while allowing greater access to commonly field installed parts such as fuses, without the necessity of having a fuse ejector, is provided by a molded flexible snap-in barrier which is received in integrally molded clips and slots in molded top cover 50. This also allows the Main Disconnect Switch Mechanism Support Base to be molded without barriers for lower voltage applications, and allows the Main Disconnect Switch Mechanism to be sold without extra parts such as built in fuse ejectors, providing more access to field installable parts, and also achieves a reduction in the overall cost of the Main Disconnect Switch Mechanism. By providing for the inclusion of flexible snap-in electric barriers, greater access to field installed parts is accomplished thus eliminating the need for items such as fuse ejectors. Since the flexible snap-in barriers are not integrally molded into the switch, the device can be manufactured without the barriers for low voltage applications. Molded top cover 50 is thus provided with integrally molded clips 70*a*, bars 70*b*, tabs 70*c*, and rails 70*d* projecting from walls 52, 53, and 51 to receive correspondingly positioned edges 90*a*, 90*b*, and slots 90*c* of flexible snap-in fuse barriers 90 for Main Disconnect Switch Mechanism operation with either a ferrule fuse clip 60*c* or blade fuse clip 60*b*. Flexible snap-in fuse barrier 90 thus serves as an improved electrical insulating barrier.

Extending upward from top surface 56 and walls 52, 54 and 51 are three hoods 72 positioned on the line side of each phase of Main Disconnect Switch Mechanism Support Base. Positioned on top surface 56 and extending around hoods 72 is a line shield 88 which is secured to top surface 56 by screw 282. Line shield 88 provides electrical isolation as well as ready access to line terminals 134 because of its ease of removal by simply unscrewing screw 282.

Figure 5:
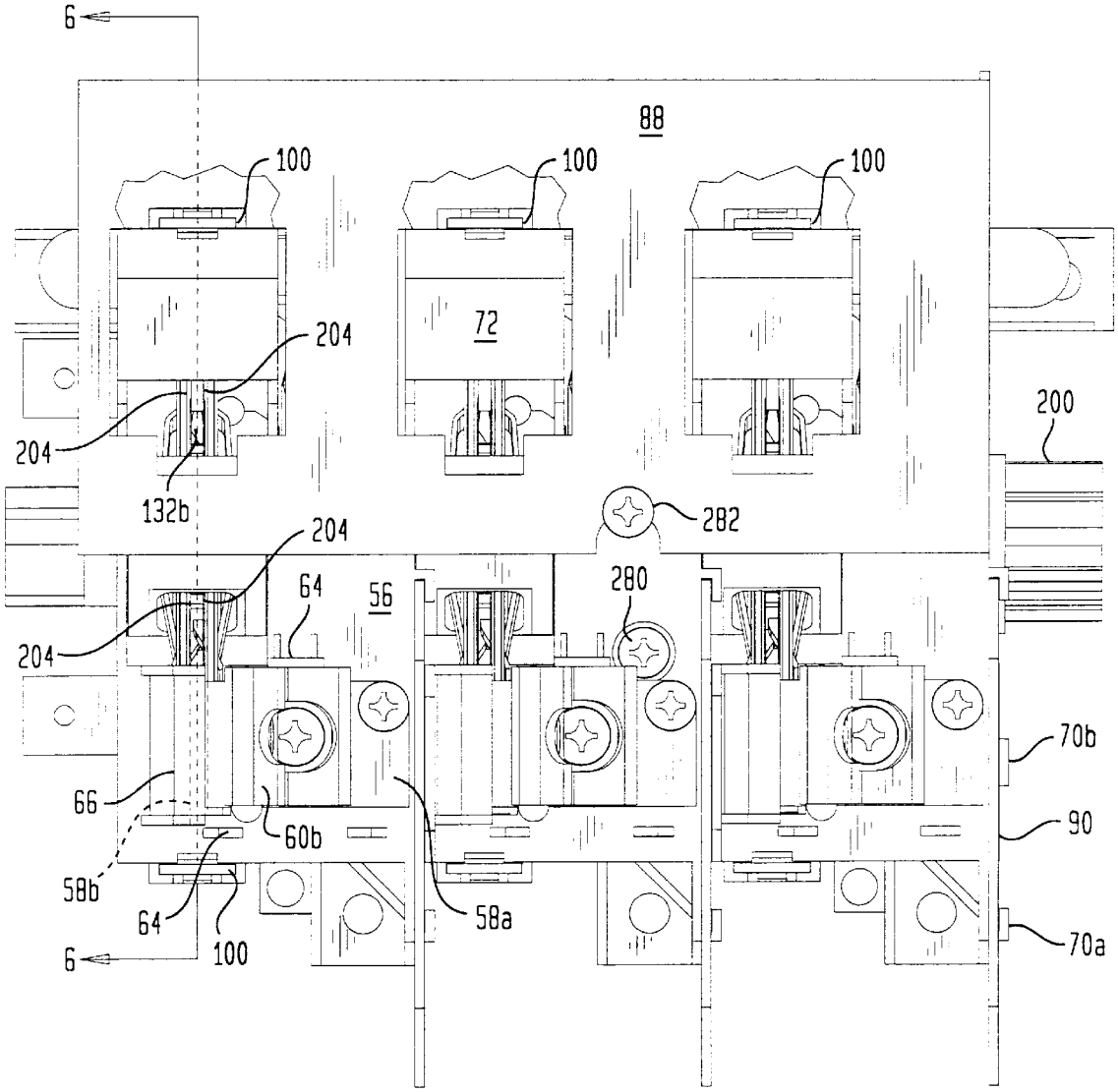
FIG. 5 is a top view of Main Disconnect Switch Mechanism Support Base shown in FIG. 2.
Figure 6:
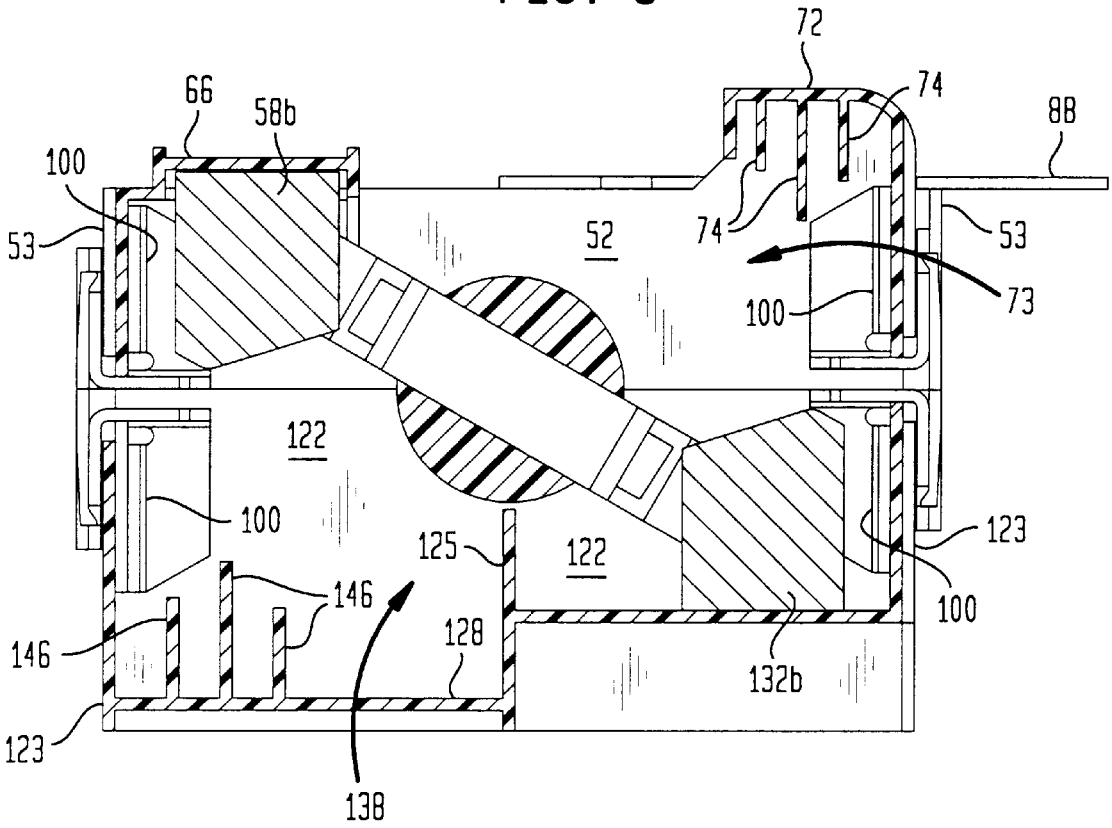
FIG. 6 is a sectional view of the Main Disconnect Switch Mechanism Support Base shown in FIG. 5 taken along line 6—6.
Figure 7:
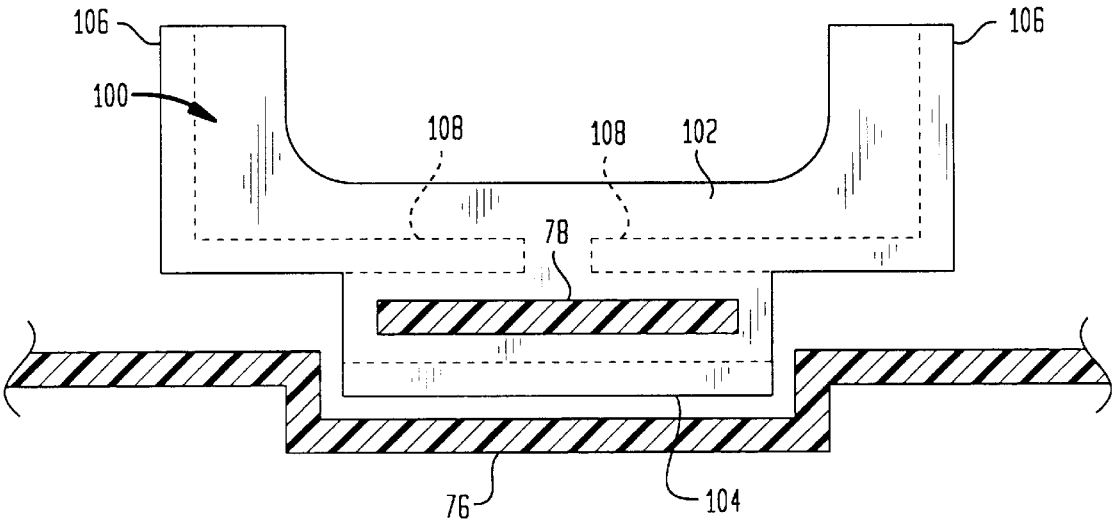
FIG. 7 is an enlarged top sectional view of a portion of the outer upstanding wall of the molded top cover shown in FIG. 3A taken along line 7—7 with an arc grid in place.
Figure 8:
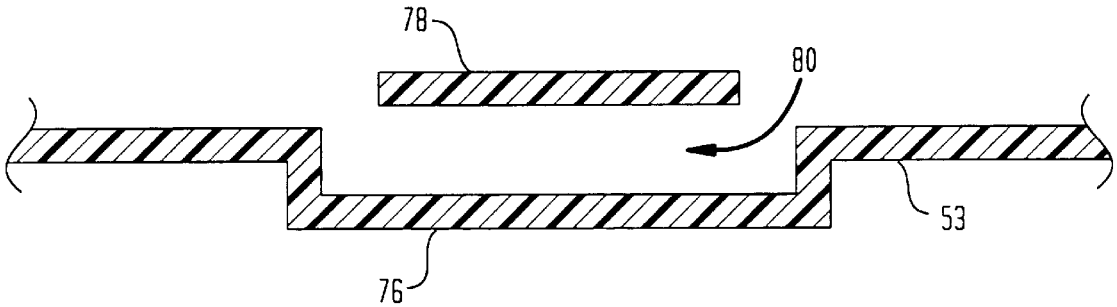
FIG. 8 is an enlarged sectional view of a portion of the outer upstanding wall of the molded top cover shown in FIG. 3A taken along line 8—8 without an arc grid.

Associated with each of the load contacts 58 and surrounding the vertical downwardly extending load contact blade 58*b* through molded slit 67 in molded top cover 50 is a snap-in arc grid or arc enclosure 100 for cooling and extinguishing the electrical arcs that may occur as the rotatable blades of the rotor assembly and the load contacts and line contacts become connected and disconnected. Each of arc grids 100 snaps into predetermined positions on depending front outer wall 53 as shown in FIG. 3A. More specifically and referring to FIG. 8, depending front wall 53 has an integrally molded protruding member 76 and a tab 78 which are so positioned relative to one another to form a slot or track 80 within which snap-in arc grid 100 is positioned as shown in FIG. 7. In addition to the arc grids installed in front wall 53, additional arc grids 100 are also snapped into position in the same manner in depending outer rear wall 53 below each of hoods 72 as shown for example in FIG. 5 and in the sectional view shown in FIG. 6.

Figure 9A:
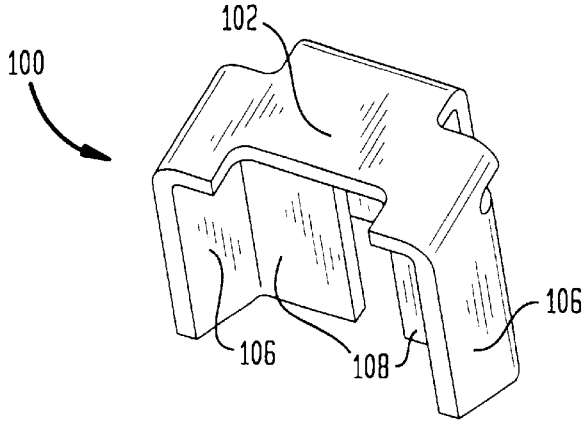
FIG. 9A is an isolated perspective frontal view of the arc grid shown in FIGS. 1,2,3A and 4.
Figure 9B:
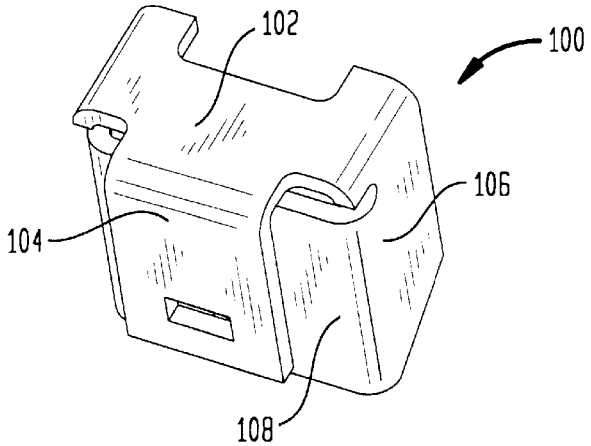
FIG. 9B is another isolated perspective view taken from the back of the arc grid shown in FIG. 9A.
Figure 9C:
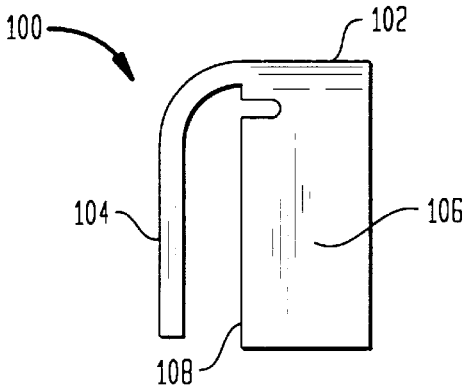
FIG. 9C is a side view of the arc grid shown in FIGS. 9A and 9B.

Arc grid 100 comprises a top 102 from which orthogonally extends at each of two opposite sides an arm 106 as shown in FIGS. 9A, 9B and 9C. Extending orthogonally from a third side of top 102 in the same direction as arms 106 is a spine 104. Extending orthogonally from each arm 106 and toward spine 104 is a shoulder 108 which forms a slot between each shoulder 108 (FIG. 9A) and a slot between spine 104 and shoulders 108 (FIG. 9C). Snap-in arc grid 100 can be formed from a single piece of steel which is stamped, punched or bent to form it into the shape shown in FIGS. 9A, 9B and 9C.

Thus, arc grids consist of a uniquely formed shape shown in FIGS. 9A, 9B and 9C which are inserted into mating recesses and tracks in both the bottom base and top cover. Each arc grid also works with the stationary contact having a larger mass than the prior art and a geometry to facilitate the movement of the arc to the back of the contact. This confines damage caused by the arc to an area that does not participate with the next operation of the disconnect. In this way, the life of the switch when operated electrically is dramatically increased.

Arc grid 100 has a geometry that enhances arc suppression. The shape of each grid is such that a plurality of sharp corners that attract arcs is presented to the arc during the operation cycle of the switch. This allows the arc to hit a multitude of locations, and breaks the arc into smaller arcs reducing the production of associated gas emissions, and thus effectively cools the arc throughout the operating life of the switch. By presenting inviting locations (i.e. sharp corners) for the arc to hit, the arc is kept from straying to other electrical phases or grounded dead metal and possibly creating a short circuit. The shape of the arc grid also provides a large surface area and steel mass to also aid in cooling arcs.

The geometry of the arc grids also allow them to be securely inserted into their final assembly position without the aid of additional fasteners. Their geometry permits their interchangeable use in both the top cover and bottom base.

Figure 4:
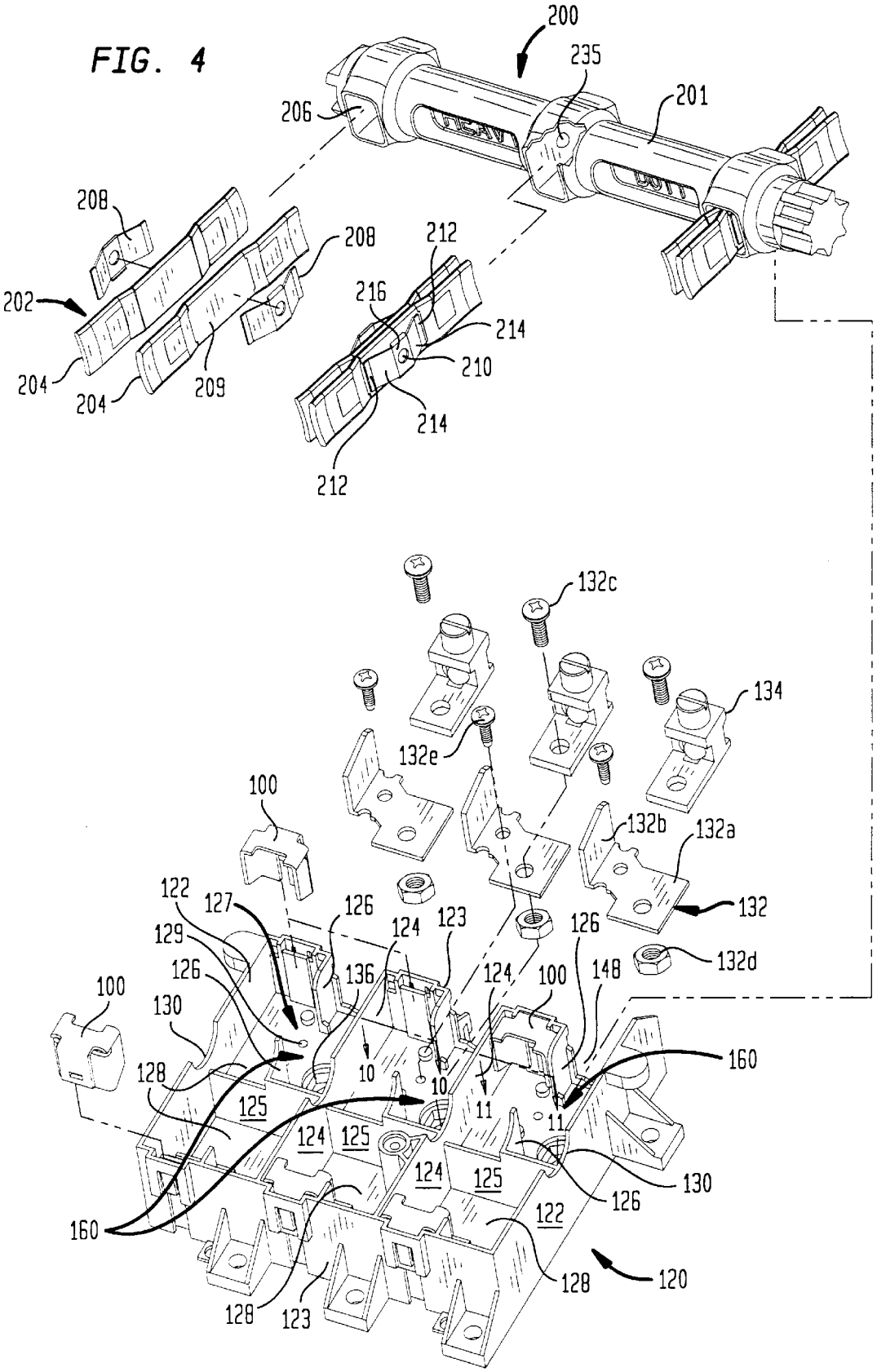
FIG. 4 is an exploded perspective view of the molded bottom base and rotor assembly of the Main Disconnect Switch Mechanism Support Base shown in FIGS. 1 and 2.

Referring to FIG. 4, molded bottom base 120 and rotor assembly 200 of Main Disconnect Switch Mechanism Support Base 30 are shown in an exploded perspective view. Extending upward from bottom surface 128 are upstanding side outer walls 122, upstanding front and rear outer walls 123, first upstanding interior walls 124 which are parallel to side outer walls 122, a second upstanding interior wall 125 which is parallel to front and rear outer walls 123, and third upstanding interior walls 126 which are parallel to side outer walls 122. Each of third interior walls 126 has an opening 127 as shown in FIG. 4. Upstanding interior wall 125 extends transverse to and intersects with side outer walls 122, interior walls 124, and interior walls 126. The interior walls divide the interior of molded base 120 so that when assembled with molded top cover 50 and the other components of the Main Disconnect Switch Mechanism Support Base 30, the Disconnect Switch Mechanism Support Base 30 is divided into compartmentalized arc chambers which function, in part, to isolate each line contact and each load contact of each phase of the switch from each other and each other line and each other load contact of each of the other phases of the switch as more fully described below. Each of walls 122 and 124 has a radial slot 130 for receiving and supporting rotor shaft 201 of rotor assembly 200. Interior wall 126 similarly has a radial slot for the rotor shaft 201 of rotor assembly 200.

Each of the three generally "L"-shaped line stationary contacts 132 has a vertical portion 132*b* for contact with the rotor blades and a horizontal portion 132*a* which is secured to a line terminal 134 by screw 132*c* and nut 132*d*. Molded recess 136 is in the shape and size of nut 132*d* and thereby prevents the rotation of the nut when securing line contact 132 to line terminal 134. In order to facilitate their assembly, a molded recess 136 is provided and receives nut 132*d* which is used to secure the line terminal 134 to line contact 132*a*. Line contacts 132 are each secured by a screw 132*e* in aperture 129 in bottom surface 128 of molded bottom base. Rear wall 123 has openings 148 in order to facilitate the mechanical connection of line cables (not shown) to the line terminals 134.

Figure 10:
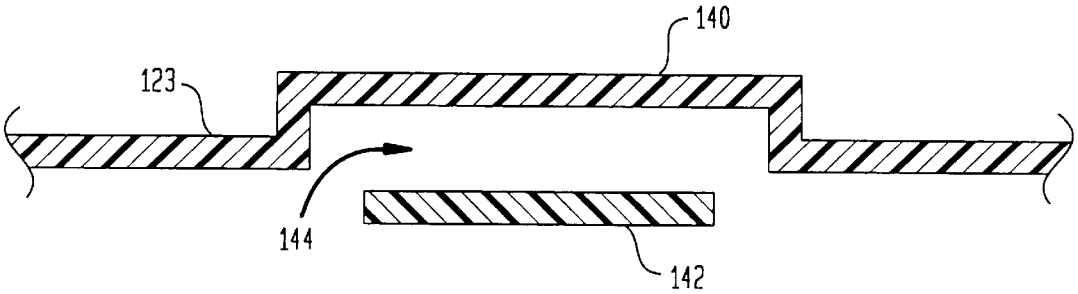
FIG. 10 is an enlarged top sectional view of a portion of the outer upstanding wall of the molded bottom base shown in FIG. 4 taken along line 10—10 without an arc grid in place.
Figure 11:
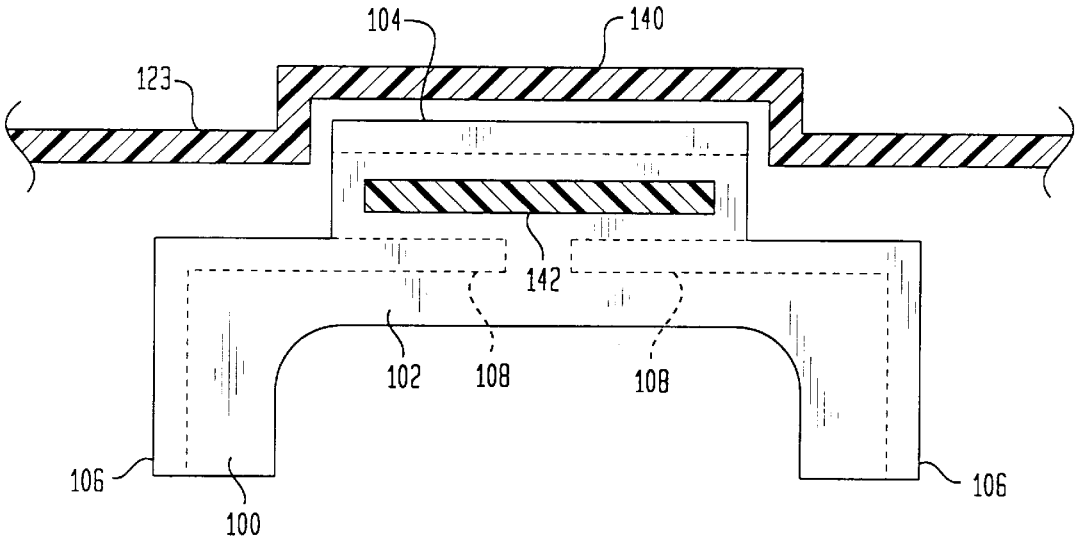
FIG. 11 is an enlarged top sectional view of a portion of the outer upstanding wall of the molded bottom base shown in FIG. 4 taken along line 11—11 with an arc grid in place.

Associated with each of the line contacts 132 and surrounding each of the vertical upwardly extending line contact blades 132*b* in the molded bottom base 120 is a snap-in arc grid 100 for cooling and extinguishing electrical arcs that may occur as the rotateable blades of the rotor assembly and the line and load contacts become connected and disconnected. Each of the arc grids 100 snaps into predetermined positions on upstanding rear outer wall 123 as shown in FIG. 4. More specifically and referring to FIG. 10, upstanding rear outer wall 123 has an integrally molded protruding member 140 and a tab 142 which are so positioned relative to one another to form a slot or track 144 within which snap-in arc grid 100 is positioned as shown in FIGS. 4 and 11. The integrally molded member 140 and tab 142 which form slot/track 144 in molded bottom base is identical to that of the molded top cover's protruding member 76, tab 78 and slot/track 80 in order that snap-in arc grids 100 can be interchangeably installed in both the molded top cover and the molded bottom base. In addition to the arc grids that are installed in rear wall 123, additional arc grids 100 are also snapped into position in the same manner in upstanding front wall 123 as shown in FIG. 4 and in the sectional view shown in FIG. 6. Once molded top cover 50 and molded bottom base 120 are assembled and secured, snap-in arc grids 100 are held in their installed positions within Main Disconnect Switch Mechanism Support Base 30 by the alignment of the mating edges of depending front and rear outer walls 53 of top cover 50 with front and rear outer walls 123 of bottom base 120.

The rotor assembly 200 which rotates to make and break contact with mating load and line contacts is of the double make/double break type and is shown in an exploded view in FIG. 4. Rotor assembly 200 comprises, for each of the three phases of the switch, a contact assembly 202 which includes a pair of curved or channel shaped conductive blades 204 having free ends which engage line and load contacts. Each pair of conductive blades 204 radially extend through and are retained in an aperture 206 through shaft 201 of the rotor 200 by a pair of springs 208 having a bowed configuration which resiliently biases conductive blades 204 toward one another. The springs 208 engage flat indentation 209 on blades 204 which when installed in aperture 206 are compressed against one another which function to continuously maintain blades 204 in a spaced parallel relation upon being disengaged from the stationary switch contacts and maintain blades 204 in contact with one another in a back to back relationship. Spring 208 has two flat portions 212 which are each connected to one of two angled portions 214 which are connected to raised portion 216. Spring 208 has an aperture 210 on raised portion 216 that engages a correspondingly positioned protrusion 235 and surface in the interior of aperture 206 to compress springs 208 and retain the blade assembly 202 within aperture 206 in a fixed position as shown in FIG. 4. The apertures 206 in the rotor shaft 201 are dimensioned so as to permit the insertion of the conductive blades 204 and springs 208. Insertion is accomplished by straight placement into aperture 206 of the assembled blades and springs without the need to turn or rotate such components before or after insertion/installation. Following insertion of the blades and springs in this manner, holes 210 in springs 208 are engaged by protrusions 235 within aperture 206 and are thereby secured in position within the rotor shaft. Thus, when assembled, each conductive blade is resiliently biased to a normal position by means of the spring having a bowed configuration having flat end members which are adapted to seat in the flat indentations in the central portion of the blade. By compressing against indentations 209 of blade 204, springs 208 also function to maintain pressure between blades 204 and the stationary line and load contacts when the switch is closed.

After rotor assembly 200 is positioned onto radial slots 130 in walls 122, 124 and 126 and molded top cover 50 is assembled to molded bottom base 120 by securing together by screw 280, and line shield 88 is similarly installed, the interior walls of top cover 50 and the interior walls of bottom base 120 divide the interior of the Main Disconnect Switch Mechanism Base into compartmentalized arc chambers in which each of the line and load contacts of each phase of the switch is isolated from each other of the line and load contacts of each other phase. More specifically, interior walls 124 of bottom base 120 and interior walls 51 of top cover 50 together with rotor shaft 201 isolate each phase from each other phase. (FIGS. 3A, 4.) Interior wall 125 of bottom base 120 and rotor shaft 201 isolates the load side from the line side of each phase of the Main Disconnect Switch Mechanism Base. Interior wall 126 of bottom base 120 and interior wall 54 and tab 55 of top cover 50 mate to contain the ionized gas from travel into the line lug compartment 160, and to ground or to poles of opposite polarity.

As shown and discussed above, for each phase of the Main Disconnect Switch Mechanism 20, four arc grids are installed. Referring to FIG. 6, an arc grid 100 is installed so that it surrounds the line contact blade 132*b* and another arc grid is installed so that it surrounds load contact blade 58*b* for each phase of the Main Disconnect Switch Mechanism. In addition, another arc grid is also installed on the line side for each phase of the switch into each upper compartment 73 of molded top cover 50 in which the rotor conductive blades 204 are disengaged from the line contact blade 132*b* when the switch is opened. Similarly, a fourth arc grid is installed on the load side for each phase of the switch into each lower compartment 138 of molded bottom base 120 in which rotor conductive blades 204 are disengaged from the load contact blade 58*b* when the switch is opened. As contrasted to the prior art devices, the Main Disconnect Switch Mechanism Base 30 has positioned within it an arc grid not only for each of the disconnect volumes associated with the line and load contacts of each phase, but also has an arc grid in each of the volumes associated with the connection of the line and load contacts of each phase. By so doing, the Main Disconnect Switch Support Base provides separate insulated arc grids causing the arc to split into smaller segments thereby reducing the core temperature of the arc and causing a voltage drop across each arc segment ultimately reducing the amount of ionized gas produced relative to an unsegmented arc.

Extending downward from the molded top cover 50 and from the underside of each hood 72 into each compartment/volume 73 are integrally molded baffles 74 comprising plastic plate-like structures which extend downward toward snap-in arc grid (FIG. 6). Similarly, extending upward from the inside surface of bottom 128 of molded bottom base 120 into compartment/volume 138 are integrally molded baffles 146 comprising plastic plate-like structures which extend upward toward snap-in arc grid. Baffles 74 and 146 help control the arc generated during disconnect operations when the conductive blades 204 of the rotor are disengaged from the line contacts 132 and load contacts 58. This is accomplished by presenting obstructions to the arc which create smaller volumes causing turbulence which assists in dissipating the heat thus helping to extinguish the arc. The baffles are not positioned within the volume or chamber in which contact is made between the rotor blades and either the line or load contacts ("make volume"), but is in a volume when the contacts are open ("break volume"). This is the preferred location of the baffles to assist in elongating and extinguishing the arc.

Thus, in accordance with an aspect of the present invention, compartmentalized arc chambers are provided for in Main Disconnect Switch Mechanism Base 30 comprising a set of current breaking members and metal snap-in arc grids enclosed by a rotor assembly 200 and fixed impermeable walls on all sides to contain, control, and/or extinguish, an electrical arc and its associated emissions generated during current interruption. The compartmentalized arc chamber enshrouds the arc and its ionic emissions generated during electrical current interruption, and allows the rotor conductive blades to translate into a position where conductivity is zero from a position where conductivity is greater than zero, while preventing and controlling the discharge of electrically charged ionized gasses to a position or location where an alternate electrical current path could be established.

Each compartmentalized arc chamber does not allow the ionized gases to escape during the operation of current switching members and commingle with surrounding volumes and/or atmosphere, although leakage eventually occurs through the interface between the line shield and the rotor shaft, as well as the interface between tab 55 and line contact 132. By not allowing such conductive gases to thereby form an electrically conductive path to ground, the design of the Main Disconnect Switch Mechanism permits the decrease of such path to ground distances.

Compartmentalization of the arc and its resultant gases generated during electrical current interruption prevents any unintended or undesirable path to ground or to a phase of opposite polarity. Therefore, the poles of the Main Disconnect Switch Mechanism 20 may be placed in closer relative proximity to one another. Thus, in accordance with another aspect of the present invention, a third compartment 160 for each phase, as best seen in FIG. 4, is provided as a barrier and further contains the ionized gas, particularly from travel to ground or to poles of opposite polarity after Main Disconnect Switch Mechanism Base 30 is assembled. More specifically, compartment 160 is formed by: walls 124, 125, 126 and rear wall 123 and bottom 128 of molded bottom base 120 (FIG. 3A); walls 51 and 53, wall 54 with integral tab 55, together with top 56; rotor shaft 201; and line shield 88. Thus, by compartmentalizing rotor conductive blades 204 with line stationary contact 132*b* for each phase of the switch within a compartmentalized arc chamber 73, and by compartmentalizing the line terminals 134 from rotor conductive blades 204 and line contact 132*b*, prevents any unintended path to ground while enabling the placement closer together of the poles of the Main Disconnect Switch Mechanism. Access into compartment 160 for routing of the line cable (not shown) is provided by openings 148 in rear wall 123. Once installed, access to line terminals 134 can be more easily accomplished by removing line shield 88.

In an alternative embodiment, the Main Disconnect Switch Mechanism 20 further includes a Fuse Support Mechanism 240 which serves as a connection means for fault interrupting devices or fuses which are placed between the load side of the Main Disconnect Switch Mechanism Support Base 30 discussed above and the load of the circuit. The Fuse Support Mechanism 240 comprises a fuse support insulative base 242 and a fuse mounting assembly 243 for each phase. The fuse mounting assembly 243 includes a fuse clip 244 as is commonly known in the art. The fuse clip can be of two types so that various amperage ratings of fuses can be used, such as either a blade type clip 244*a* or a ferrule type clip 244*b*. Both types are shown with the fuse support insulative base 240 in FIGS. 12 and 13. If preferred, a fuse rejector pin 258 can be used. Either the blade clip 244*a* or the ferrule clip 244*b* is mounted to a current conducting bus strap 246. Bus strap 246 also serves to connect the blade clip or the ferrule clip to a terminal lug 248 for connection to an electric current carrying load wire. These terminals can either be attached at the place of manufacture or in the field by the end user.

Fuse support insulative base 242 as well as Main Disconnect Switch Support Base 230 can be made from a variety of materials having electrical insulative properties such as ceramics, thermoset or thermoplastics. The insulative base 242 has a recess 250 in the shape of the nut to prevent its rotation during assembly.

The insulative base 242 includes fins 252 that provide the spacing needed to prevent the possibility of short circuits from developing either through the air or over the surface between adjacent fuse clip pole assemblies when energized. Insulative base 242 also includes anti-turn recess 254 for the bus strap 246 and anti-turn node 256 for terminals lugs 248.

While the foregoing description and drawings represent the preferred embodiments of the present invention, it will be apparent to those skilled in the art that various changes and modifications may be made therein without departing from the true spirit and scope of the present invention.

We claim:

1. A multiple phase fusible switch assembly having a main disconnect switch mechanism support base comprising:

(a) a molded bottom base having a bottom surface, upstanding side outer walls, upstanding front and rear outer walls, first upstanding interior walls, and second upstanding interior walls transverse to the first upstanding interior walls, dividing the interior of the bottom base for isolating each phase of the switch;

(b) a molded top cover having a top surface, depending side outer walls, depending front and rear outer walls, and first depending interior walls, dividing the interior of the top cover for isolating each phase of the switch;

(c) the molded top cover being mountable to the molded bottom base wherein the depending side outer walls and the depending front and rear outer walls of the top cover are in mutual engagement with the upstanding side outer walls and the upstanding front and rear outer walls of the bottom base, and the first upstanding interior walls of the bottom base are in mutual engagement with the first depending interior walls of the top cover to form phase to phase separation chambers for isolating each phase in the main disconnect switch mechanism support base;

(d) a plurality of pairs of stationary contacts comprising a line contact secured to the bottom surface of the base in each of the phase to phase separation chambers and a load contact secured to the top surface and extending into each of the phase to phase separation chambers;

(e) receiving means disposed in the molded bottom base in proximity to the line contact and disposed in the molded top cover in proximity to the load contact in each of the phase to phase separation chambers for receiving arc extinguishing devices;

(f) a rotor assembly supported and guided by the upstanding side outer walls of the bottom base and the depending side outer walls of the top cover, the rotor assembly having a rotor shaft arranged between the molded top cover and molded bottom base and between the line contact and the load contact for rotating a contact assembly between the line contact and the load contact to make circuit connection between the line contact and the load contact in each of the phase to phase separation chambers; and (g) wherein the second upstanding interior wall has a free edge in mutual engagement with the rotor shaft to form a barrier between the line contact and the load contact in each of the phase to phase separation chambers to form compartmentalized arc chambers isolating each line contact and each load contact of each phase of the switch from each other, and from each other line contact and each other load contact of each other phase of the main disconnect switch support base.

2. The switch as in claim 1 wherein the means for receiving arc extinguishing devices is in the front outer wall of the molded bottom base and in the rear outer wall in the molded top cover.

3. The switch as in claim 2 wherein the means for receiving arc extinguishing devices is in the rear outer wall of the molded bottom base and in the front outer wall in the molded top cover.

4. The switch as in claim 3 wherein the means for receiving arc extinguishing devices includes an integrally molded protruding member and a tab of upstanding rear outer wall of molded bottom base for receiving a snap-in arc grid and an integrally molded protruding member and a tab of depending front wall of molded top cover for receiving a snap-in arc grid.

5. The switch as in claim 4 wherein the means for receiving arc extinguishing devices includes an integrally molded protruding member and a tab in the front outer wall of the molded bottom base and the rear depending outer wall in the molded top cover.

6. The switch as in claim 5 further including arc extinguishing devices at least one of which comprises an arc grid comprising a top from which an arm orthogonally extends at each of two opposite sides of the top, a spine extending orthogonally from a third side of top in the same direction as the arms and a shoulder extending orthogonally from each arm and toward the spine which forms a slot between the spine and the shoulders.

7. The switch as in claim 6 wherein the arc grid is formed from a single piece of metal.

8. The switch as in claim 7 wherein arc grids are inserted into the means for receiving arc extinguishing devices disposed in the rear outer wall of the molded bottom base and in the front outer wall of the molded top cover.

9. The switch as in claim 8 wherein arc grids are inserted into the means for receiving arc extinguishing devices disposed in the front wall of the molded bottom base and in the rear wall of the molded top cover.

10. The switch as in claim 5 wherein the top surface of molded top cover has a hood extending from within and downward from which are integrally molded baffles comprising plate like structures and into a compartmentalized arc chamber and wherein the bottom surface molded bottom base has integrally molded upwardly extending baffles comprising plate like structures extending into a compartmentalized arc chamber for controlling the arcs generated during disconnect operations when the conductive blades of the rotor are disengaged from the line contact and the load contact.

11. The switch as in claim 10 further including a line shield.

12. The switch as in claim 11 further including a line terminal secured to the line contact.

13. The switch as in claim 12 further including a load terminal secured to the load contact.

14. The switch as in claim 12 further including an interchangeable contact selected from the group consisting of a load terminal and a load ferrule fuse clip and a load blade fuse clip.

15. The switch as in claim 12 further including a load blade fuse clip secured to the load contact.

16. The switch as in claim 13 wherein the top surface of the top cover has a molded recess in the shape of a nut for receiving a nut to secure the load terminal to the load contact by a screw.

17. The switch as in claim 14 wherein the top surface of the molded top cover has a molded recess in the shape of a nut for receiving a nut to secure the interchangeable contact to the load contact by a screw.

18. The switch as in claim 14 wherein the bottom surface of the molded top cover has a molded recess in the shape of a nut for receiving a nut to secure the line terminal to the line contact.

19. The switch as in claim 18 wherein the top surface of the molded top cover further includes anti-turn members for preventing the rotation of an assembled line terminal and line contact.

20. The switch as in claim 18 wherein the molded bottom base has a third upstanding wall extending transverse to and between the rear outer wall and the second upstanding interior wall, the third upstanding wall having an opening therein, and wherein the second depending interior wall of the molded top cover has a molded tab which is received in the opening in the third upstanding wall in the molded bottom base when the molded bottom base is secured to the molded top cover to thereby form a barrier between the line terminal and the line contact and form a line lug compartment to limit the ionized gases from travel to the line lug compartment and to ground and to poles of opposite polarity.

21. The switch as in claim 1 further including a fuse support mechanism means for connecting a fault interrupting device placed between and in electrical contact with the load side of the main disconnect switch support base and a load of the switch.

22. The switch as in claim 21 wherein the fault interrupting device is a fuse.

23. The switch as in claim 22 wherein the fuse support mechanism comprises a fuse support insulative base and a fuse mounting assembly comprising a fuse clip mounted to a connecting bus strap connecting the fuse clip to a terminal lug for connection to a load of the switch.

* * * * *